US005906232A

United States Patent [19]

Bauer et al.

[11] Patent Number: 5,906,232

[45] Date of Patent: May 25, 1999

[54] WINDOW BLIND ASSEMBLY

[75] Inventors: Michael R. Bauer, Oaklawn; Tao Xu, Woodbridge; Harold F. Marcoux, Aurora; Eugene D. Rider, Naperville, all of Ill.

[73] Assignee: Risk Analysis & Management, Oak Brook, Ill.

[21] Appl. No.: 09/095,148

[22] Filed: Jun. 10, 1998

[51] Int. Cl.[6] ..... E06B 9/30

[52] U.S. Cl. ..... 160/170 R

[58] Field of Search ..... 160/170 R, 171 R, 160/168.1 R, 172 R, 173 R, 178.1 R, 84.01, 84.02, 176.1 R, 300, 301, 302, 308

[56] References Cited

U.S. PATENT DOCUMENTS

| | | | |
|---|---|---|---|
| 2,231,778 | 2/1941 | Swanson | 156/17 |
| 2,276,716 | 3/1942 | Cardona | 156/17 |
| 2,598,887 | 6/1952 | Burns | 160/170 |
| 2,701,611 | 2/1955 | Griesser | 160/170 |
| 2,758,644 | 8/1956 | Virlouvet | 160/170 |
| 3,581,798 | 6/1971 | Malamed | 160/168 |
| 5,123,472 | 6/1992 | Nagashima et al. | 160/170 |
| 5,628,356 | 5/1997 | Marocco | 160/170 |

FOREIGN PATENT DOCUMENTS

WO 93/18269 9/1993 WIPO .

*Primary Examiner*—David M. Purol
*Attorney, Agent, or Firm*—Finnegan, Henderson, Farabow, Garrett & Dunner, L.L.P.

[57] ABSTRACT

A window blind assembly is provided. A header mounts near a window. A window blind is moveable between a raised position near the header and a lowered position over a portion of the window. A shaft is rotatably mounted in the header and connected to the blind such that rotation in a first direction raises the blind, and rotation in a second direction lowers the blind. A brake engages the shaft to prevent rotation in the first direction, but allows rotation in the second direction to lower the blind when a downward force is applied to the blind. A brake release is engaged with the brake and is configured such that activation of the brake release releases the brake, allowing the shaft to rotate in the first direction and raise the blind, until deactivation of the brake release causes the brake to reengage the shaft.

23 Claims, 1 Drawing Sheet

WINDOW BLIND ASSEMBLY

BACKGROUND OF THE INVENTION

1. Field of the Invention

The present invention relates to a window blind assembly, and more particularly to a slatted window blind assembly wherein the blind can be raised or lowered without requiring an adjustment cord.

2. Description of the Related Art

Slatted window blinds, including Venetian blinds, mini-blinds, Roman blinds, and the like are well known. These blinds typically include a plurality of slats, mounted in a slat ladder, depending from a header mounted near an upper portion of a window. The slatted blind can be raised or lowered, to uncover or cover the window, as desired. The angle of the slats also can be adjusted in, for example, a Venetian blind or a mini-blind.

Raising and lowering the blind is usually performed with a cord that extends up to a raising/lowering mechanism located in the header. Typically, the cord defines a loop.

This looped cord poses a strangulation hazard, particularly for small children who can become entangled in the cord. A search of the Consumer Product Safety Commission database for the years 1990–1992 revealed that fifty (50) strangulation incidents caused by window blind cords were reported during that time period.

Efforts have been made to reduce the strangulation hazard posed by the cords of slatted blinds. One solution that has been proposed is to cut the cord so that the loop is eliminated. This can result in the blind being positioned unevenly, and is undesirable. Also, children can still become entangled in the cord.

Other efforts have been made to combine a slatted blind with a raising/lowering mechanism from a conventional window shade, using no cord at all. These efforts also have proven generally unsuccessful.

A window blind assembly is needed that can raise and lower a slafted blind easily and effectively, yet eliminate the strangulation hazard.

SUMMARY OF THE INVENTION

Accordingly, the present invention is directed to a window blind assembly that substantially obviates one or more problems due to limitations and disadvantages of the related art.

Additional features and advantages of the invention will be set forth in the description which follows, and in part will be apparent from the description, or may be learned by practice of the invention. The advantages of the invention will be realized and attained by the apparatus particularly pointed out in the written description and claims below, as well as the attached drawings.

To achieve these and other advantages, and in accordance with the purpose of the invention, as embodied and broadly described herein, the invention comprises a window blind assembly. The window blind assembly includes a header mountable proximate a window. A window blind is moveable, when the header is mounted, between a raised position with the window blind compressed proximate the header, and a lowered position with the window blind extended over at least a portion of the window. A shaft biased to rotate in a first rotational direction is rotatably mounted in the header and connected to the window blind such that rotation of the shaft in the first rotational direction raises the blind to one of a plurality of positions from the lowered position to the raised position, and rotation of the shaft in a second rotational direction lowers the blind to one of a plurality of positions from the raised position to the lowered position. A brake is engaged with the shaft to prevent rotation in the first rotational direction, but allows rotation of the shaft in the second rotational direction to lower the blind at times when a force is applied to the window blind in the direction of the lowered position. A brake release is engaged with the brake and configured such that activation of the brake release releases the brake, allowing rotation of the shaft in the first rotational direction to raise the blind, until deactivation of the brake release causes the brake to reengage with the shaft.

In another aspect, the shaft includes a gear having a plurality of teeth, fixed to the shaft to rotate with the shaft. The brake includes a locking pawl configured to engage the gear teeth to prevent rotation in the first rotational direction. The brake release includes an activating device for moving the locking pawl out of engagement with the gear teeth, allowing the shaft to rotate in the first rotational direction. The activating device includes a cord, connected to a cam, and a rocker arm projecting from the cam to the locking pawl, such that a pull on the cord rotates the cam and rocker arm, thereby rotating the locking pawl out of engagement with the gear teeth. Preferably, the cord is substantially enclosed by a wand.

It is to be understood that both the foregoing general description and the following detailed description are exemplary and explanatory and are intended to provide further explanation of the invention as claimed.

BRIEF DESCRIPTION OF THE DRAWING

The drawing is included to provide a further understanding of the invention, constitutes a part of the specification, illustrates a preferred embodiment of the invention, and together with the description serves to explain the principles of the invention.

DESCRIPTION OF THE PREFERRED EMBODIMENT

Figure 1:
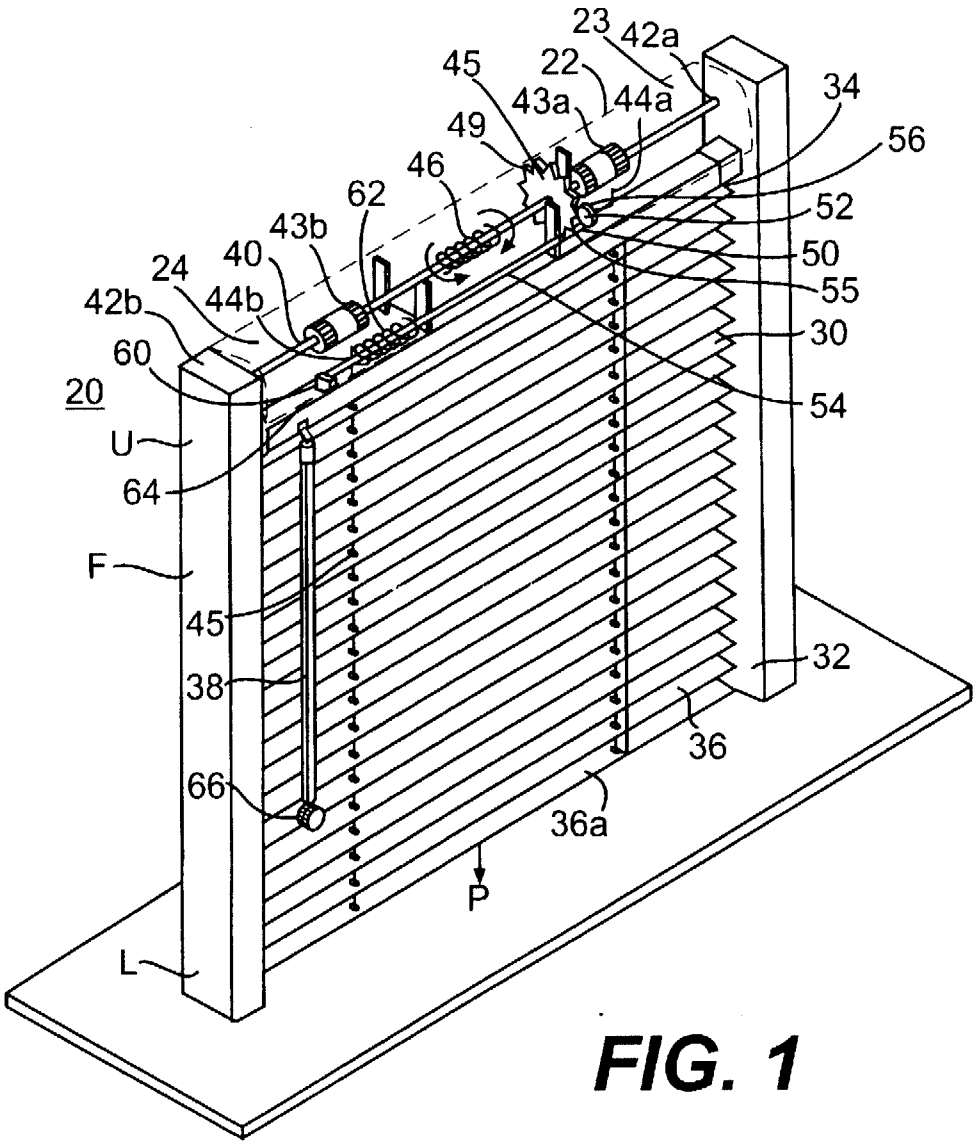
FIG. 1 is a perspective view of a window blind assembly in accordance with the present invention.

The exemplary embodiment of the window blind assembly of the present invention is shown in FIG. 1, and is designated generally by reference numeral 20.

In accordance with the invention, the window blind assembly includes a header mountable proximate a window. As embodied hereon, and referring to FIG. 1, a window W (not shown) includes a frame F, having an upper portion U and a lower portion L. A header 22 includes a generally U-shaped bracket 23 (shown in relief) defining a channel 24. The channel 24 can be closed off with a plate 26 (not shown). Header 22 defines a housing for the raising and lowering mechanism for the window blind, as described below. The header 22 is mounted proximate window W. Preferably, header 22 is mounted proximate the upper portion U of window frame F with conventional fasteners (not shown).

In accordance with the invention, the window blind assembly further includes a window blind moveable, when the header is mounted, between a raised position with the window blind compressed proximate the header, and a lowered position with the window blind extended over at least a portion of the window. Referring to FIG. 1, a window blind 30 is provided. Window blind 30 can be positioned in any one of a plurality of positions in between, and including, a fully-lowered position 32, which in this case substantially covers window W as shown in FIG. 1, and a fully-raised position 34, in which the window blind 30 is raised and compressed into a compact form in the vicinity of header 22, fully exposing window W. It will be understood that the amount of window W that can be covered depends on the length of window blind 30, and the length is not critical to the invention.

Preferably, window blind 30 is a slatted blind. As shown in FIG. 1, window blind 30 is a Venetian blind or a mini-blind, made up of a plurality of slats 36 held in descending sequence on a slat ladder 37 (not shown). The slats 36 includes a lowermost slat 36*a*. However, the invention is not limited to a Venetian blind or a mini-blind. Any type of slatted blind, such as a Roman blind, also can be used with the invention.

It is preferred that the angular position of the slats be adjustable. In the case of a Venetian blind or a mini-blind, a slat adjustment wand 38 connects to a conventional slat angle adjustment mechanism (not shown). Rotation of slat angle adjustment wand 38 manipulates the slat angle adjustment mechanism, which in turn rotates the slat ladder 37 to alter the angular position of the slats 36 to a desired angular position. This slat adjustment feature is conventional, and will not be described further.

In accordance with the invention, a shaft biased to rotate in a first rotational direction is rotatably mounted in the header and connected to the window blind such that rotation of the shaft in the first rotational direction raises the blind to one of a plurality of positions from the lowered position to the raised position, and rotation of the shaft in a second rotational direction lowers the blind to one of a plurality of positions from the raised position to the lowered position. As shown in FIG. 1, an elongated shaft 40 is rotatably mounted at distal ends 42*a*, 42*b*, to a pair of brackets (not shown) inside U-shaped channel 24. A pair of pulleys 43*a*, 43*b* are attached to shaft 40 at positions intermediate the distal ends 42*a*, 42*b*. A pair of cords 44*a*, 44*b* depend from the pulleys 43*a*, 43*b*, through a series of aligned apertures 45 in the window blind 30. These cords 44*a*, 44*b* are fixed to the lowermost slat 36*a*. When the blind is raised, cords 44*a*, 44*b* wind about pulleys 43*a*, 43*b*, and pull the lowermost slat 36*a* and successive slats 36 upward towards the raised position, with the slats 36 successively collapsing and pressing against one another. One of ordinary skill will recognize that the blind 30 can be moved to any position between, and including, the fully raised position 34 and the fully lowered position 32, as desired by the operator.

Preferably, and referring to FIG. 1, shaft 40 rotates in a clockwise direction C to raise the blind 30 and a counterclockwise direction CC to lower the blind 30. The clockwise, or raising direction, will be referred to as the first rotational direction, and the counterclockwise or lowering direction will be referred to as the second rotational direction. As shown in the drawings, a take-up spring 46, preferably a coil spring, is wound about shaft 40 and connected to shaft 40, and is compressed by rotation of the shaft 40 in the second rotational direction, or counterclockwise (lowering) direction. In other words, winding of shaft 40 in the second rotational or counterclockwise direction CC to lower the blind 30, occurs counter to the force of spring 46, which attempts to urge shaft 40 to wind in the first rotational or counterclockwise direction CC. The lower the blind 30 is lowered, the more spring force is stored in spring 46 urging the shaft 40 to turn in the opposite direction. Although a spring is shown and preferred, any structure which biases shaft 40 to rotate in the first rotational direction is within the scope of the invention.

The shaft 40 further includes a gear 48 mounted intermediate the distal ends 42*a*, 42*b*. Gear 48 is fixed to shaft 40 and accordingly rotates with shaft 40. Gear 48 is a standard gear having multiple teeth 49. The purpose of gear 48 is explained below.

In accordance with the invention, a brake is provided to engage the shaft to prevent rotation in the first rotational direction, but allow rotation of the shaft in the second rotational direction to lower the blind at times when a force is applied to the window blind in the direction of the lowered position. Referring to FIG. 1, a ratchet mechanism 50 includes a pawl 52 fixed to a rocker arm 54. The pawl 52 is flat on one side 55 and arcuate on the opposite side 56. Flat side 55 of pawl 52 contacts the surface of a corresponding tooth 49 on gear 48.

Ratchet mechanism 50 works as a brake in the following manner. When a downward force, e.g., a pulling force P, is applied in the lowering direction to the lowermost slat 36*a*, shaft 40 and gear 48 rotate in the second rotational, or counterclockwise direction. As each tooth 49 of gear 48 pushes in turn on flat surface 55 of pawl 52, pawl 52 and rocker arm 54 rotate clockwise until tooth 49 bypasses pawl 52. As long as the pulling force P is applied in the lowering direction to slat 36*a*, the teeth 49 of gear 48 will keep rotating pawl 52 out of the way, and the window blind 30 will lower in the direction of lowered position 32. When the pulling force P is released, pawl 52 will lock in place between two teeth 49, and the window blind 30 will stop in position.

It will be understood that as the shaft 40 rotates in the second rotational direction, spring 46 will be consistently wound tighter, and will be applying a continually increasing biasing force to the shaft 40 to rotate in the first rotational or clockwise rotational direction C. However, pawl 52 of ratchet mechanism 50 prevents rotation of shaft 40 in the first direction. This is because the clearances of the components in the vicinity of ratchet mechanism 50 do not allow pawl 52 to be rotated counterclockwise. Therefore, pawl 52 acts as a brake, preventing rotation of gear 48 and shaft 40 in the first rotational direction, as long as pawl 52 engages teeth 49.

In accordance with the invention, a brake release is engaged with the brake and configured such that activation of the brake release releases the brake, allowing rotation of the shaft in the first rotational direction to raise the blind, until deactivation of the brake release causes the brake to reengage with the shaft. Referring to FIG. 1, a brake release mechanism preferably includes a cam 60 fixed to the opposite distal end of rocker arm 54, a spring 62 coiled about rocker arm 54, and a cord 64 depending from cam 60. It is preferred that cord 64 be encased in a wand, which preferably is the same slat adjustment wand 38 used to change the angular position of the slats 36. It is also preferred that a handle or knob 66 be fixed to a lower end of cord 64.

The brake release operates as follows. Pulling downward on knob 66 pulls cord 64 downward, which in turn rotates cam 60 in a clockwise direction C'. Rotation of cam 60 in turn rotates rocker arm 54 in the clockwise direction C', which in turn rotates pawl 52 clockwise and out of engagement with gear 48. This clockwise rotation of rocker arm 54 is counter to the urging force of a spring 62, preferably a coil spring wound about rocker arm 54. Hence, release of knob 66 permits rocker arm 54, with the urging of spring 62, to rotate counterclockwise, until pawl 52 reengages gear 48.

During the period that pawl 52 is rotated out of engagement with gear 48, shaft 40 is free to rotate in the first rotational or clockwise direction C, under the bias of wound coil spring 46. Rotation of shaft 40 in the first rotational direction raises the blind 30, as cords 44*a*, 44*b* are wound around pulleys 43*a*, 43*b*.

Blind 30 continues to raise until it reaches the fully-raised position 34, or until cord 64 is released. As discussed above, release of cord 64 results in rocker arm 54, under the urging of spring 62, to rotate counter-clockwise, causing reengagement of pawl 52 and gear 48, with blind 30 stopping at the position it is in at the time cord 64 is released.

The invention described above enables raising and lowering of a window blind without use of an exposed looped cord or another cord which may pose a strangulation hazard. As mentioned above, cord 64 is enclosed within slat adjustment wand 38. Because this cord is not exposed, it does not pose a strangulation hazard.

Additional advantages and modifications will occur readily to persons of ordinary skill in the art. The invention in its broadest aspects, therefore, is not limited to the specific details and representative apparatus described above. Departures may be made from such details without departing from the invention. The scope of the invention is measured by the attached claims and their legal equivalents.

What is claimed is:

1. A window blind assembly comprising:

a header mountable proximate a window;

a window blind moveable, when the header is mounted, between a raised position with the window blind compressed proximate the header, and a lowered position with the window blind extended over at least a portion of the window;

a shaft biased to rotate in a first rotational direction rotatably mounted in the header and connected to the window blind such that rotation of the shaft in the first rotational direction raises the blind to one of a plurality of positions from the lowered position to the raised position, and rotation of the shaft in a second rotational direction lowers the blind to one of a plurality of positions from the raised position to the lowered position;

a brake engaged with the shaft to prevent rotation in the first rotational direction, but allow rotation of the shaft in the second rotational direction to lower the blind at times when a force is applied to the window blind in the direction of the lowered position; and a brake release engaged with the brake and configured such that activation of the brake release releases the brake, allowing rotation of the shaft in the first rotational direction to raise the blind, until deactivation of the brake release causes the brake to reengage with the shaft.

2. The window blind assembly of claim 1, wherein the header includes a generally U-shaped channel enclosing the shaft and the brake.

3. The window blind assembly of claim 1, wherein the window blind includes a plurality of slats.

4. The window blind assembly of claim 3, further comprising a device for changing an angle of the slats with respect to the window.

5. The window blind assembly of claim 4, wherein the device for changing the angle of the slats includes a ladder holding the slats, said ladder being moveable to pivot each slat and change the angle of the slat.

6. The window blind assembly of claim 4, further comprising a wand projecting from the header for manipulating the device for changing the angle of the slats.

7. The window blind assembly of claim 1, further comprising a spring biasing the shaft to rotate in the first rotational direction.

8. The window blind assembly of claim 1, wherein the shaft includes a gear having a plurality of teeth, fixed to the shaft to rotate with the shaft.

9. The window blind assembly of claim 8, wherein the brake includes a locking pawl configured to engage the gear teeth to prevent rotation in the first rotational direction.

10. The window blind assembly of claim 9, wherein the brake release includes an activating device for moving the locking pawl out of engagement with the gear teeth, allowing the shaft to rotate in the first rotational direction.

11. The window blind assembly of claim 10, wherein the activating device includes a cord connected to a cam, and a rocker arm projecting from the cam to the locking pawl, such that a pulling force on the cord rotates the cam and rocker arm, thereby rotating the locking pawl out of engagement with the gear teeth.

12. The window blind assembly of claim 11, wherein the cord is substantially enclosed by a wand.

13. The window blind assembly to claim 11, further comprising a second spring for biasing the rocker arm to rotate the locking pawl back into engagement with the gear teeth when the pulling force on the cord is released.

14. The window blind assembly of claim 1, wherein the window blind includes a cord extending through the blind, and the shaft includes a pulley around which the cord winds and unwinds as the window blind is raised and lowered, respectively.

15. A window blind assembly, comprising:

a header mountable proximate a window;

a window blind moveable, when the header is mounted, between a raised position with the window blind compressed proximate the header, and a lowered position with the window blind extended over at least a portion of the window;

a shaft biased to rotate in a first rotational direction rotatably mounted in the header and connected to the window blind such that rotation of the shaft in the first rotational direction raises the blind to one of a plurality of positions from the lowered position to the raised position, and rotation of the shaft in a second rotational direction lowers the blind to one of a plurality of positions from the raised position to the lowered position;

a gear fixed to the shaft to rotate with the shaft, having a plurality of gear teeth;

a rocker arm rotatably mounted in the header proximate the shaft;

a pawl fixed to the rocker arm and engageable with the gear teeth to prevent rotation of the shaft in the first rotational direction, but allow rotation of the shaft, while the pawl and gear teeth are engaged, only in the second rotational direction;

a cam fixed to the rocker arm; and a cord depending from the cam such that a pulling force applied to the cord rotates the cam and the rocker arm, disengaging the pawl from the gear teeth, and allowing rotation of the shaft in the first rotational direction.

16. The window blind assembly of claim 15, wherein the window blind includes a plurality of slats.

17. The window blind assembly of claim 16, further comprising a device for changing an angular position of the slats.

18. The window blind assembly of claim 15, wherein the cord is substantially enclosed by a wand.

19. The window blind assembly of claim 14, further comprising a spring biasing the shaft to rotate in the first rotational direction.

20. A header for use in a window blind assembly, comprising:

a housing defining a channel;

a shaft rotatably mounted in the channel, biased to rotate in a first rotational direction;

a gear having a plurality of teeth fixed to the shaft to rotate with the shaft;

a pawl rotatably mounted proximate the shaft and engageable with the gear teeth to prevent rotation of the shaft in the first rotational direction, but allow rotation of the shaft in a second rotational direction while engaged with the gear teeth; and a cord coupled to the pawl and depending from the channel, application of a pulling force to which rotates the pawl out of engagement with the gear teeth, thereby permitting rotation of the shaft in the first rotational direction.

21. The header of claim 20, further comprising pulleys mounted on the shaft for attaching to a window blind depending from the channel.

22. The header of claim 20, wherein the cord is substantially enclosed by a wand.

23. The header of claim 20, further comprising a rocker arm rotatably mounted in the channel proximate the shaft and connected to the pawl, a rocker arm including a cam connected to the cord.

* * * * *